United States Patent [19]

Samford

[11] 4,285,407

[45] Aug. 25, 1981

[54] STRAIGHT HOLE DRILLER

[76] Inventor: Travis L. Samford, 6110 Elmgrove, Spring, Tex. 77379

[21] Appl. No.: 104,277

[22] Filed: Dec. 17, 1979

[51] Int. Cl.[3] ..... E21C 17/00

[52] U.S. Cl. ..... 175/323; 175/406

[58] Field of Search ..... 175/325, 406, 344, 323

[56] References Cited

U.S. PATENT DOCUMENTS

| | | | |
|---|---|---|---|
| 1,801,968 | 4/1931 | Montgomery | 175/406 |
| 1,844,371 | 2/1932 | Santiago | 175/406 |
| 1,848,128 | 3/1932 | Hinderliter | 175/406 |
| 3,338,069 | 8/1967 | Ortloff | 175/406 |
| 3,343,615 | 9/1967 | Terry | 175/406 |
| 3,851,719 | 12/1974 | Thompson et al. | 175/406 |

FOREIGN PATENT DOCUMENTS

| | | | |
|---|---|---|---|
| 607943 | 6/1975 | U.S.S.R. | 175/406 |

*Primary Examiner*—James A. Leppink
*Attorney, Agent, or Firm*—Gunn, Lee & Jackson

[57] ABSTRACT

For use in a drilling string, the preferred and illustrated embodiment depicts a drill collar to be placed in the lower parts of the drill string for straightening the hole. The preferred embodiment utilizes a generally square drill collar with a thick or heavy wall. It is square in cross section along the greater portion of its length, the four corners being slightly rounded to a specified diameter on rotation, and the four lengthwise corners of the regular cross section are all reinforced with hardfacing material to a specified depth, typically tungsten carbide. The four edges abrade the bore hole as the drill string penetrates the earth. In addition, the lower end of the tubular body includes lengthwise flutes in the form known on a stabilizer to guide the hole straightening device into the hole to be reamed by operation of the device.

8 Claims, 4 Drawing Figures

FIG. 1
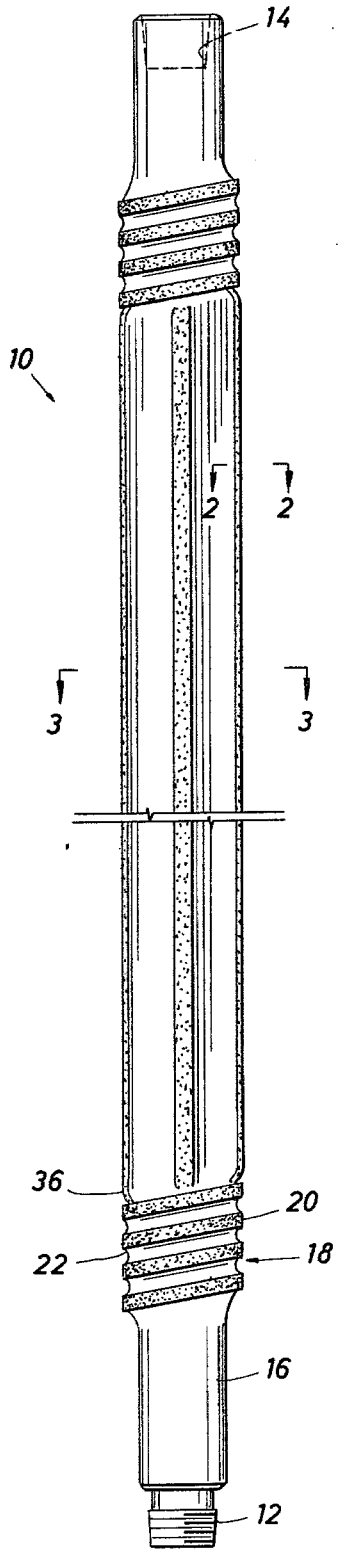
FIG. 2
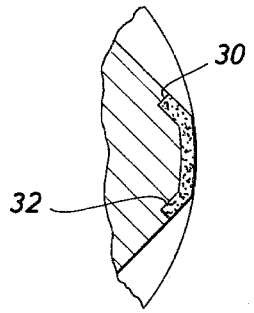
FIG. 3
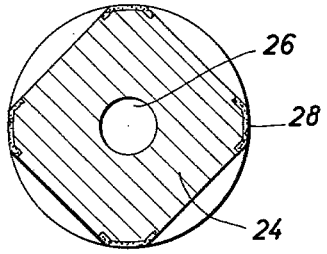
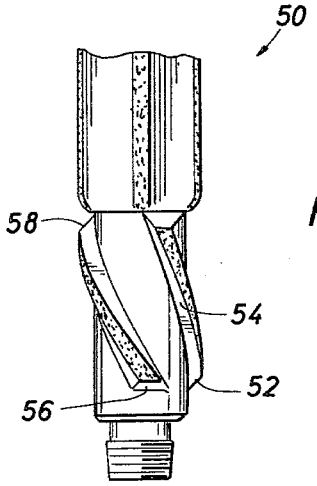
FIG. 4

STRAIGHT HOLE DRILLER

BACKGROUND OF THE DISCLOSURE

In drilling an oil well, the drill bit theoretically cuts a round hole which is advanced into the earth. In practice, the hole is never quite perfectly round, and, moreover, the drill bit will drift occasionally, thereby forming a deviated well. In many instances, these deviations are not important. However, they do create problems when they become extreme. Such problems arise as, for example, in the drifting of a drill bit whereby the drill string above the drill bit works over against the wall of the drilled hole. This can become extreme, even to the point where the drill string will stick. Sticking ordinarily occurs in the drill collars, not in the drill pipe, because the drill collars are slightly larger in diameter. The present invention is an apparatus to be incorporated in the drill string, perhaps at two or three locations, so that the drilled hole can be enlarged, thereby permitting obstructions to be cut away through use of the present invention. It has, therefore, as one feature a means which abrades the previously drilled hole to enlarge the hole slightly at obstructions which rub against the drill string, particularly in the area of the drill collars.

The present invention is particularly advantageous in that it includes means which aligns the apparatus with the hole. As the drill string advances, each joint in the drill collars can be deflected slightly. The present invention features means which cut away the nearest obstruction to the drill collars so that hanging of a drill collar is markedly reduced. This apparatus, therefore, encounters such an obstruction, is guided into operative contact with the obstruction and cuts into the obstruction as the drill string is rotated and advanced. One embodiment of the present invention incorporates a bottom spiral of several turns which aligns the remainder of the hole straightening apparatus with the obstruction by feeding in the bottom helical thread on the tool. This embodiment utilizes hardfacing material on the thread.

An alternate embodiment of the present invention utilizes flutes at the bottom of the hole straightening apparatus. The bottom located flutes align the hole straightening apparatus with the hole as it first enters the deviated area. Moreover, annular clearance is permitted through the flutes for the mud return flow path adjacent to the drill string. Thus, the mud flow passes through the flutes and parallel to the face of the hole straightening apparatus. This enables the deviated area to be straightened with a minimum of difficulty.

With the foregoing in mind, this apparatus is briefly summarized as hole straightening apparatus utilizing an elongate tubular member having a square cross section. The square cross section extends the greater portion of the length, thereby defining four corners. The four corners are rounded, that is to say, they are arcuately shaped and surfaced with hardfacing material. At the lower end, straight flutes, helical flutes or a spiral thread is incorporated to advance the tool into the deviated area of the well. They are also equipped with hardfacing material.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

FIG. 1 is a side view of one embodiment of the hole straightening apparatus of the present invention depicting a bottom helical thread, straight ribs along the greater portion thereof and a top located helical thread;

FIG. 2 is a partial sectional view of one edge of the tubular member shown in FIG. 1 showing a hardfacing insert on that edge;

FIG. 3 is a sectional view through the body of the apparatus taken along the line 3—3 of FIG. 1 showing the four corners thereof and the common diameter for the tubular body; and FIG. 4 shows an alternate lower portion wherein splines are located below the rectangular cross-sectional area.

DETAILED DESCRIPTION OF THE ILLUSTRATED EMBODIMENTS

Attention is first directed to FIG. 1 of the drawings, where the preferred and illustrated embodiment is identified by the numeral 10. Alternate embodiments are included, and they will be discussed after a description of the embodiment 10. This apparatus terminates at a pin 12 which is constructed in accordance with industry standards to engage drill collars and drill pipe in a drill string. The opposite end of the tool is a box 14 which provides the mating thread. This enables the connection of the tool in the drill string. The tool is axially hollow between pin and box so that mud can flow downwardly through the drill string and through the hole straightening apparatus 10.

A description of the tool will proceed from bottom to top. The pin is joined to a tubular section of cylindrical cross section identified at 16. It extends upwardly to a threaded portion 18. The threaded portion 18 incorporates a thread which advances downhole on rotation of the drill string in the conventional direction. The thread 18 incorporates an upstanding crown area 20 set apart from adjacent threads by a valley or groove 22. The crown area has a specified width. It also stands to a specified height so that, on rotation, the crown 20 of the several turns cuts or carves to a uniform diameter in the hole. This normally does not occur if the drill string is in a hole which is not deviated. Deviations, however, do occur, and the top or crown portion 20 of the thread comes into contact with the deviated hole. The crown is formed with hardfacing material. The hardfacing material is placed on it to a specified depth of perhaps 0.25 inch or so. It preferably spans the full width of the crown, typically up to about 1.0 inch. The hardfacing material is preferably particles of tungsten carbide supported in a softer alloy matrix which is joined to the structure. The hardfacing material is sacrificial and typically will be worn away during extended use in operation of the present invention. The threaded area cuts into the deviations as the drill string advances. The threads 18 do not cut a groove in the deviated area. Typically, the drill string is advanced very slowly so that the threads cut away the hole, forming what is ideally a cylindrical hole. Between three and six turns are adequate. The groove 22 is provided so that drilling mud can flush away cuttings through the groove. Moreover, differential pressure sticking is less likely to occur at the grooved area. A single lead thread is ordinarily sufficient.

It will be observed in FIG. 1 that the helical thread swings a specified diameter on rotation. This is referred to hereinafter as the cut diameter. The cut diameter is the ideal diameter of the hole which would be formed by the tool. This is the diameter that is observed in FIG. 3 of the drawings. FIG. 3 shows the threads 18 from above to illustrate how the cut diameter is related to the dimensions of other parts of the device.

The hole straightening apparatus 10 has a square cross section in the upper part of the tool. The square cross section is defined by a thickened body 24. It is axially penetrated by the passage 26 which conducts mud through the tool. The thick wall portion 24 is generally square. The corners have been rounded as depicted in FIG. 2. FIG. 2 shows a first corner of the square. It will be understood that this extends significantly along the hole straightening apparatus 10, and, therefore, this corner defines what might actually be termed a lengthwise rib 28. There are four, and they are preferably identical, all coinciding with the cut diameter shown in FIG. 3. The four ribs, being identical, are constructed in like manner. Each comprises hardfacing material which is placed in an inset better shown in FIG. 2. An inset area at 30 is cut in the stock which comprises the body, and hardfacing material is built up in that recessed area. The hardfacing material, again, is tungsten carbide particles in a supportive alloy matrix. The hardfacing material extends outwardly to the cut diameter as depicted in FIG. 2. It provides suitable width in the center so that a fairly broad abrasive surface is presented to the deviated hole. It is also equipped with edge located skirts 32 along both edges, thereby broadening the contact area of the tool. This broadened contact area is able to prevent undercutting of the hardfacing material, thereby preserving the softer metal body against wear. This permits redressing of the tool to restore the hardfacing material to full gauge thickness.

FIG. 1 depicts a radius of curvature at 36 at each of the lengthwise ribs. This enables the hardfaced rib to enter into the deviated hole area subject to guidance by the lowermost threads 18, thereby preventing snagging of corners. Thus, the body portion of the hole straightening apparatus 10 is square in cross section, but sharp corners are avoided and are replaced by hardfacing material placed on the corners.

In FIG. 4 of the drawings, an alternate embodiment is identified by the numeral 50. Raised flutes 52 are included. They have a common cut diameter which coincides with the cut diameter defined above. The several flutes preferably number three or four. They serve as a centrallizing guide positioning the hole straightener 50 in the deviated hole area. Moreover, they are installed with a helical turn proceeding such that the face 54 advances into the deviated area. The face 54 is the face which confronts the hole during rotation. It approaches the hole in a broadside fashion, not in the form of the screw thread shown in FIG. 1. This tends to centrallize the hole straightener 50. The flutes 52 terminate short of the square portion. They are supported on the round, tubular, lower shank of the tool.

The stabilizer flutes 52 are not merely stabilizer flutes; they are guides so that the remaining four ribs on the tool which comprise the greater length of the tool enter the deviated area with optimum alignment. This prevents abrading action against other portions of the hole which, while deviated, are deviated in a direction where it makes little difference. As will be appreciated, the tool of the present invention particularly cuts away key seats formed in the drilled hole. It is very helpful to cut away a key seat area inasmuch as it creates a lot of drag on the drill string and tends to wear it unduly.

The flutes 52 are equipped with hardfacing material on the top of the flutes. It extends to a specified depth, perhaps in the range of 0.25 to 0.50 inch. If desired, the face 54 can be fully covered with hardfacing material to the very root of the flute. This is ordinarily not necessary because contact normally occurs at the top face with only slight contact occurring on the edge of the top face.

It will be observed in FIG. 4 of the drawings that the flutes 52 are tapered at the lower end 56 and the upper end 58. This, again, reduces snagging of the flutes against sharp points in the deviated hole. Depending on the rate of penetration which is a scale factor dependent on many other factors, the flutes can be straight. That is to say, they can be straight along the length of the lower cylindrical shank of the tool. It is preferable that such straight flutes also extend outwardly to the same or common cut diameter depicted in FIG. 2 of the drawings. It is not necessary that the flutes at the lower part of the tool align with the ribs in the central portion of the tool.

The upper end of the tool can be constructed with a duplicate thread as shown in FIG. 1. Such a duplicate thread does not ordinarily encounter the same amount of wear as the lower portions of the tool. However, it is advantageous to include it where the duplicate thread is equal to or larger than the cut diameter so that it can fully and completely clear the deviated portion as the drill string passes through it. Once it clears the deviated area, the drill collars which are located above the hole straightener 10 or 50 then easily enter the deviated area with a markedly improved chance of passing through it without becoming stuck.

The materials used in the present invention are those used in other drill collars. The body of the tool is fairly high quality steel, typically in the range of 4140 or harder. The hardfacing material is granulated tungsten carbide particles supported in an alloy matrix for adhering the particles to the tool. The hardfacing material can be replaced.

The apparatus of this disclosure can be formed in several sizes dependent on the size of the well to be drilled, the length of the drill collars deemed appropriate and varied in accordance with other scale factors.

While the foregoing is directed to the preferred embodiments of the present invention, other and further embodiments of the invention may be devised without departing from the basic concept thereof, and the scope thereof is determined by the claims which follow.

I claim:

1. For use in a drill string positioned in a well which deviates, a hole straightening apparatus which comprises:

(a) an elongate, axially hollow, tubular member terminating in threaded connections enabling said tubular member to be connected in a drill string;

(b) said tubular member defining an intermediate section forming a plurality of substantially flat surfaces and a plurality of lengthwise straight ribs positioned between adjacent flat surfaces, said lengthwise ribs extending radially outwardly to a specified distance such that, on rotation of the drill string, each of said ribs contacts the deviated well bore to cut against the deviated hole and wherein said ribs each includes exposed hardfacing material thereon and wherein said ribs stand radially further than the adjacent portion of said external face; and (c) bottom located helical flute means being positioned beneath said ribs and at least partially encircling said tubular member and having a raised portion formed of hardfacing material on said external face to guide and advance said tubular member in a well bore.

2. The apparatus of claim 1 wherein said tubular member is, in cross section, formed of generally rectangular stock defining four corners, each of said corners being rounded and having hardfacing material thereon and each of which comprises a lengthwise rib, and wherein all of said ribs, on rotation, have a common radial height.

3. The apparatus of claim 2 including four sides on said rectangular stock which define said substantially flat surfaces and collectively comprise a portion of said external face and wherein said ribs are separated from adjacent ribs thereby.

4. For use in a drill string positioned in a well which deviates, a hole straightening apparatus which comprises:

(a) an elongate, axially hollow, tubular member terminating in threaded connections enabling said tubular member to be connected in a drill string;

(b) an external face on said tubular member having at least one lengthwise rib extending radially outwardly to a specified distance such that, on rotation of the drill string, said rib contacts the deviated well bore to cut against the deviated hole and wherein said rib includes exposed hardfacing material thereon and wherein said rib stands radially further than the adjacent portion of said external face; and (c) bottom located flute means having a raised portion formed of hardfacing material on said external face to guide and advance said tubular member in a well bore and having a multiturn thread encircling a specified number of revolutions around said tubular member and wherein said thread includes hardfacing material on the crown thereof adapted to contact against the well bore and further wherein said thread has a radial extent which, on rotation, is equal to or less than the radial extent of said rib on rotation.

5. The apparatus of claim 4 including a second thread located above said rib on said tubular member and wherein said first and second threads have a lead advancing said tubular member downhole on rotation of the drill string in the customary direction for drilling.

6. The apparatus of claim 5 including four sides on said rectangular stock which collectively comprise a portion of said external face and wherein said ribs are separated from adjacent ribs thereby.

7. The apparatus of claim 2 wherein said flute means are three or more flutes.

8. The apparatus of claim 7 wherein said flute means are raised ribs extending from a cylindrical surface on said tubular member.

* * * * *